US009869121B2

(12) United States Patent
Medawar

(10) Patent No.: US 9,869,121 B2
(45) Date of Patent: Jan. 16, 2018

(54) SECURITY DISPLAY CASE

(71) Applicant: Samuel C. Medawar, Lansing, MI (US)

(72) Inventor: Samuel C. Medawar, Lansing, MI (US)

( * ) Notice: Subject to any disclaimer, the term of this patent is extended or adjusted under 35 U.S.C. 154(b) by 56 days.

(21) Appl. No.: 15/016,901

(22) Filed: Feb. 5, 2016

(65) Prior Publication Data

US 2017/0167182 A1 Jun. 15, 2017

Related U.S. Application Data

(63) Continuation-in-part of application No. 14/966,092, filed on Dec. 11, 2015, now Pat. No. 9,512,663.

(60) Provisional application No. 62/091,976, filed on Dec. 15, 2014.

(51) Int. Cl.

| | |
|---|---|
| ***E05G 1/02*** | (2006.01) |
| ***A47F 3/00*** | (2006.01) |
| ***A47F 7/024*** | (2006.01) |
| ***E05B 65/00*** | (2006.01) |
| ***E05G 1/04*** | (2006.01) |
| *E05C 9/02* | (2006.01) |

(52) U.S. Cl.

CPC ..... *E05G 1/02* (2013.01); *A47F 3/002* (2013.01); *A47F 7/024* (2013.01); *E05B 65/0075* (2013.01); *E05G 1/04* (2013.01); *E05C 9/02* (2013.01); *E05Y 2800/74* (2013.01)

(58) Field of Classification Search

CPC ..... E05B 65/0075; E05G 1/02; E05G 1/00; E05G 1/005; E05G 1/024; E05G 1/026; E05G 2700/02; E05G 1/04; B65D 25/22; Y10T 70/5031; E05Y 2800/74; E05Y 2800/426; A47F 3/002; A47F 7/024

USPC ..... 109/47

See application file for complete search history.

(56) References Cited

U.S. PATENT DOCUMENTS 4,422,313 A * 12/1983 VanderWyde ..... E05B 13/001 292/26
5,209,168 A * 5/1993 Chapron ..... E05B 17/2084 109/59 T
5,733,021 A * 3/1998 O'Neill ..... A47F 3/002 312/114

(Continued)

FOREIGN PATENT DOCUMENTS

EP 0521728 A1 * 1/1993 ..... A47F 3/002

*Primary Examiner* — Suzanne Barrett
(74) *Attorney, Agent, or Firm* — The Weintraub Group, P.L.C.

(57) ABSTRACT

The present invention is a security display case comprising an enclosure defining a safe portion, a display housing with a lift platform, a top wall, and a closure member, the display housing moveable into and out of the safe portion, a lift mechanism disposed in the safe portion drivingly connected to the lift platform, the lift mechanism controlled by a first drive motor, a locking mechanism mounted within the enclosure comprising at least one disc adapted to rotatably extend into and retract into a gap provided between the top wall and closure member of the display housing, the locking mechanism controlled by a second drive motor, and a control system controlling the first and second drive motors, the control system further comprising a lower limit switch, an upper limit switch, a locking trip switch, and an unlocking trip switch.

10 Claims, 6 Drawing Sheets

(56) References Cited

U.S. PATENT DOCUMENTS

| | | | | |
|---|---|---|---|---|
| 2006/0102812 | A1* | 5/2006 | Cvek | A47B 21/007 248/125.2 |
| 2008/0174215 | A1* | 7/2008 | Amstutz | A47F 3/002 312/117 |
| 2009/0217714 | A1* | 9/2009 | O'Leary | E05B 47/023 70/84 |

* cited by examiner

SECURITY DISPLAY CASE

CROSS-REFERENCE TO RELATED APPLICATIONS

This application is a continuation-in-part application of co-pending U.S. patent application Ser. No. 14/966,092, filed Dec. 11, 2015 for "Security Display Case," which is a completion application of U.S. Patent Application Ser. No. 62/091,976, filed Dec. 15, 2014, for "Security Display Case," the entire disclosures of which are hereby incorporated by reference in their entirety including the drawings.

BACKGROUND OF THE INVENTION

1. Field of the Invention

The present invention relates to display cases which include a built-in storage safe. More particularly, the present invention relates to display cases which move the display structure between a security position and a display position. Even more particularly, the present invention relates to such a display case which is either wall mounted or seated on a floor.

2. Description of the Prior Art

Display cases are widely known for use in a variety of environments, including for displaying high-value articles such as jewelry, coins, watches, cameras, and the like. A typical display case has one or more glass windows and, thus, is particularly susceptible to theft when a criminal smashes the glass and removes as many valuable articles as possible before escaping.

Oftentimes, retailers will remove high-value items from their display cases at the close of business daily and relocate the merchandise into more secure storage. This routine transfer of goods between a display case and a security storage vault causes the problem of increased labor required to perform the relocation of display items at the end and beginning of a business day. Other problems include a possible wear and tear on the merchandise and display fixtures, and increased problems with inventory and loss control.

Accordingly, it would be of significant advantage to provide a security display case which would secure merchandise from possible theft without requiring the removal of the merchandise for safe storage after and between business hours. Further, secure in situ storage would protect the merchandise from fire after business hours.

Secure display cases are known, and typically include mechanisms for lowering a display shelf within a display case. These mechanisms oftentimes vary from motorized linear lifts to scissor jack lift assemblies. However, these devices are difficult to install in existing display cases or are difficult to use and/or unreliable over long term use. Further, some of the existing systems tend to operate very slowly and may not be effective in smash and grab daytime robberies.

Examples of apparatus related to security display cases are disclosed in Sands, EP 0521728A1, directed to a Security Receptacle, McCabe, U.S. Pat. No. 636,449 for a "Portable Elevator," and Salter, U.S. Pat. Pub. 2007/0194674 for "Lifting and Barrier Mechanism."

Another security display case is disclosed in U.S. Pat. No. 9,078,531 by Samuel C. Medawar, the Applicant herein, the disclosure of which is hereby incorporation by reference in its entirety, including the drawing. The display case shown therein includes a safe portion having a pair of panels pivotally connected thereto and adapted to be pivoted by a mechanism between open and closed positions, a display housing connected to the safe portion, and a scissors-like lift mechanism mounted in the safe portion for moving a lift platform supporting items to be displayed between security and display positions.

In the above referred to co-pending application, there is disclosed a security display case having a safe portion and a display portion movable within the safe portion. The display portion includes a top wall and a locking mechanism having a linkage system of latch fingers which operate to lock the display portion to the safe portion.

The present invention seeks to improve upon the co-pending application by providing a simplified locking mechanism mounted within the safe portion to lock the display portion within the safe portion.

The above publications are identified herein in recognition of a duty of disclosure of related subject matter, which may be relevant under 37 CFR 1.56, and specifically incorporated herein by reference as regards the conventional approaches and constructions taught therein.

Additionally, while each of the devices disclosed in the above prior published documents are believed to have been suitable for the uses and problems then intended to solve, there is an ongoing need for improvements in the design of security display cases, such as simpler and more compact designs and ease of operation.

Accordingly, it is to be appreciated that there is a need for improvements in security display cases, such as embodied in the invention herein.

SUMMARY OF THE INVENTION

The present invention is directed to a security display case for easily moving items on display, such as jewelry, guns, collectables, and like, between a security position and a display position, when desired, and to secure the displayed items in the safe without having to transfer the merchandise to and from the display area after and before business hours.

The present invention, a security display case generally comprises: (a) an enclosure having an interior that defines a lower safe portion; and (b) a display housing having a lower lift platform, a top wall opposite the lift platform, and a steel lid or closure member mounted distally above the top wall. The display housing is mounted in said safe portion for movement between a lowered security position, wherein the display housing is completely within the safe portion and the safe portion is securely sealed by the closure member, and a raised display position permitting items within the display housing to be viewed.

The display case includes a locking assembly for locking the display housing within the enclosure when the display housing is in the security position, and a lift mechanism in the safe portion, the lift mechanism being connected to the lift platform for moving the display housing between the security and display positions.

The locking assembly includes at least one disc adapted to be rotated from locking engagement with the display housing when in the security position. Preferably, a pair of locking assemblies are used and mounted on opposing sides of the safe portion. Even more preferably, each locking assembly includes a plurality of discs which are simultaneously rotated to engage the display housing.

The lift mechanism includes an axially elongated threaded drive rod at opposite respective sides of the enclosure, the rods extending between the upper and lower ends of the safe portion and operably threadably connected to the lift platform, and a first drive motor for transmitting rotational torque substantially simultaneously to each of the drive rods.

A second drive motor is provided for rotating the at least one disc into and from locking and disengaged positions with the display housing while in the security position.

A control system controls the lift mechanism and locking assembly. The control system includes a lower and upper limit switch that de-energizes the first drive motor, a lock and unlock switch that de-energizes the second drive motor, and an actuator switch connected to said motors and positionable in either an "up" or a "down" position to selectively cause the display housing to move between the security and display positions, respectively.

In operation, when the display housing is in the safe portion, the actuator switch operates in the "up" position to actuate the second drive motor and disengage the at least one disc in order to free the display housing for vertical movement from the security position in the safe portion to the display position. Once the display housing is unlocked, the unlock trip switch is engaged, thus de-energizing the second drive motor and energizing the first drive motor to raise the lift platform to the display position.

Movement of the actuator switch to the "down" position causes the display housing to move in a downward vertical direction from the display position into the safe portion whereupon the lower limit switch is engaged, thus de-energizing the first drive motor and energizing the second drive motor to rotate the at least one disc and extend into a gap provided between the top wall and closure member of the display housing.

Alternatively, the first and second drive motors may be separately activated by associated actuator switches wherein the unlock trip switch does not energize the first drive motor and the lower limit switch does not energize the second drive motor.

In a second aspect of the present invention, a security display case comprises: (a) an enclosure including a safe portion having upper and lower ends; (b) a locking assembly disposed opposite the upper end of the safe portion; (c) a display portion extending upwardly from the upper end of the safe portion to a top end portion, said display portion having a pair of opaque sidewalls, a back wall, and a front wall which is at least partially transparent; and (d) a display housing movable between a lowered security position enclosed completely within the safe portion and a raised display position disposed, at least in part, within the display portion.

The display housing includes a lower lift platform, for supporting and displaying articles when the display housing is disposed in the display portion, a top wall spaced above the lift platform, and a steel lid or closure member mounted to and spaced above the top wall, the closure member being adapted to securely enclose the display housing in the safe portion when the display housing is lowered and in the security position.

A locking assembly is mounted within the safe portion of the enclosure and adapted to releasably lock the display housing relative to the enclosure when the display housing is disposed in the security position.

The locking assembly includes at least one disc. Preferably, a pair of locking assemblies are used, one mounted proximate the front wall of the safe portion and another proximate the back wall of the safe portion. Even more preferably, each locking assembly comprises a plurality of discs, the plurality of discs being adapted to rotate between an unlocked and locked position, thereby extending and retracting into and from retained relation when the display housing is in the safe portion.

A lift mechanism is provided for moving the lift platform between the security and display positions, the lift mechanism being disposed in the safe portion of the enclosure and connected to the lift platform.

The lift mechanism includes a pair of axially elongated drive rods, a connecting arrangement for connecting the drive rods to the lift platform, a mounting arrangement for mounting opposite ends of the drive rods to the upper and lower ends of the safe portion for relative rotation thereto, and drive means for simultaneously rotating each of the drive rods whereby the interconnections between the rods and lift platform cause the lift platform to move axially vertically relative to the drive rods and to move vertically between a respective security and display positions. The connecting arrangement includes a pair of drive blocks mounted on opposite respective sides of the lift platform, each drive block having a threaded through bore, and the drive rods are threaded and threadably connected to the through bore of a respective drive block, in situ rotation of the drive rods in one or the other direction causing the drive blocks to move the lift platform up or down depending on the sense of the rotation.

The drive means comprises a first drive motor and a second drive motor connected to the locking assembly, such that energization of the first drive motor rotates the drive rods to moves the lift platform vertically relative to the drive rods and between the security and display positions and the second drive motor rotates the at least one disc into and from a locking position to releasably lock and unlock the display housing in the security position. In this arrangement, the first drive motor is disposed in the safe portion below the display housing and includes a pair of drive shafts, each drive shaft being drivingly connected to a respective drive rod. Preferably, each drive shaft terminates in a gear member that is drivingly connected to the lower end of a respective drive rod such that rotation of the drive shafts causes the gear members to rotate and substantially simultaneously transmit rotational torque to each of the drive rods.

Additionally, the security display case further comprises means for stabilizing the lift platform for parallel movement relative to the enclosure during movement of the lift platform between said security and display positions. According to this arrangement, there is provided first and second pairs of guide members with associated guide rods, the respective pairs of guide members being mounted on one and the other drive block with each guide member receiving a respective guide rod, the guide rods being within and extending between the upper and lower ends of the safe portion and constraining the lift platform to be oriented horizontally when moving between the security and display positions.

A control system is operably connected to the lift mechanism and locking assembly. The control system includes a key operated actuator switch, an upper and lower limit switch, and an unlock and lock trip switch. The trip switches, limit switches, and motors are in electrical communication with one another with the switches being adapted to de-energize the associated motor upon being engaged. The trip switches are disposed in the locking assembly. The lower limit switch is proximate the lower end portion of the safe portion and the upper limit switch is proximate to the upper end of the safe portion, the limit switches being adapted to be engaged by the lower lift platform and de-energize the first drive motor when the display housing reaches the display position.

The actuator switch is adapted to energize either the first or second drive motor based on the direction the actuator switch is positioned. In the "up" direction, the second drive motor is energized to retract the at least one disc from the outwardly rotated locking position. Upon unlocking, the unlock trip switch is engaged which de-energizes the second drive motor and energizes the first drive motor, thus raising the lift platform. When the actuator switch is in the "down" position, the first drive motor is energized, thus lowering the lift platform. Upon being completely lowered, the lower limit switch is engaged, which de-energizes the first drive motor and energizes the second drive motor to rotate the at least one disc and lock the display housing inside the enclosure.

Alternatively, the first and second drive motors may be separately activated by associated actuator switches wherein the unlock trip switch does not energize the first drive motor and the lower limit switch does not energize the second drive motor.

In one preferred arrangement, the display housing includes a front and rear wall that are at least partially transparent in the display portion of the enclosure and extend between the sidewalls and each sidewall being opaque. In another preferred arrangement, the rear wall is opaque and mounted to the wall of a room into which the display case is to be utilized.

The present invention will be more clearly understood with reference to the accompanying drawing and to the following Detailed Description, in which like reference numerals refer to like parts and where:

DETAILED DESCRIPTION OF THE INVENTION

Figure 1:
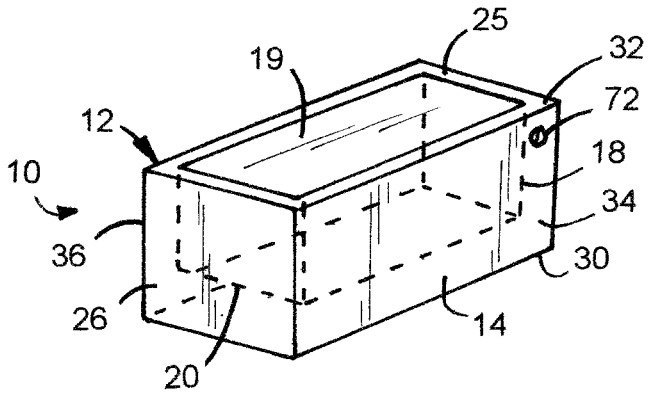
FIG. 1 is a perspective view of a security display case according to the present invention with a vertically movable display housing for supporting items to be displayed when lowered into a lower safe portion of the security case and secured therein.
Figure 2:
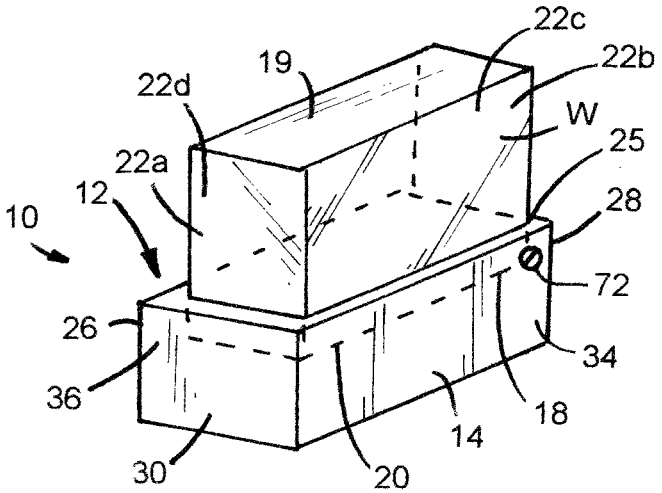
FIG. 2 is a perspective view of the display case of FIG. 1 showing the display housing in a display position.
Figure 3:
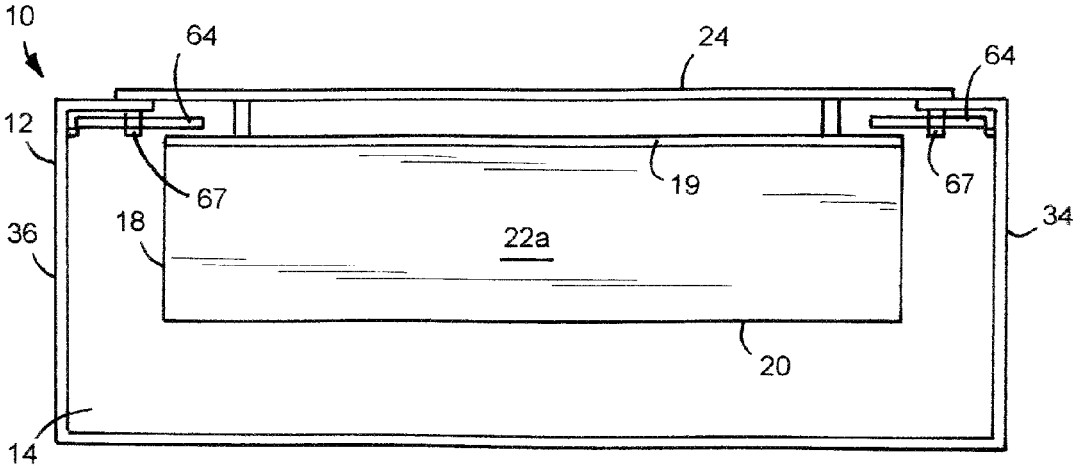
FIG. 3 is a partial cross-sectional end view of the display case illustrating the interior of the display case when the display housing is lowered into the safe portion and at least one disc in the extended position.
Figure 4:
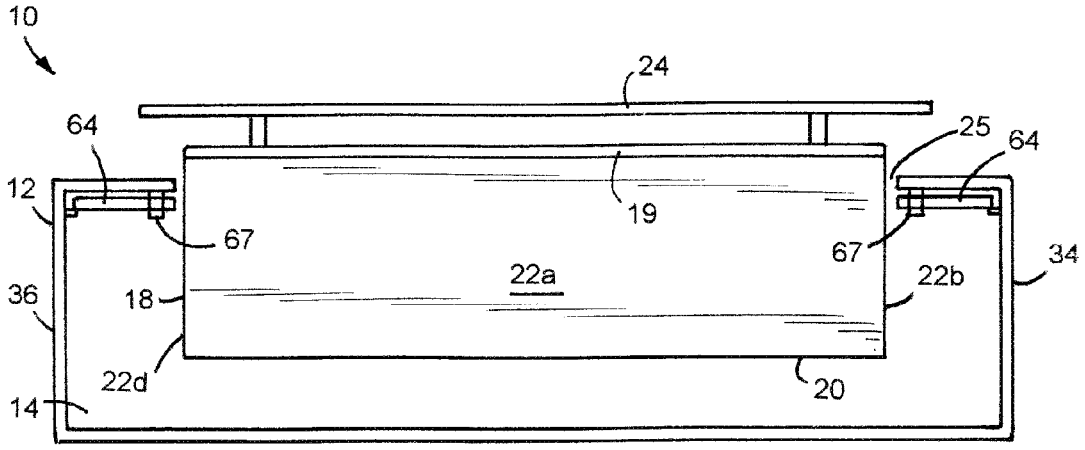
FIG. 4 is a view similar to FIG. 3, but showing the at least one disc in the retracted position and the display housing partially raised.

Turning now to the drawing, FIGS. 1-4, 6A, 6B, 7A, and 7B show a security display case 10 for easily moving items from a display position (FIG. 2) into a safe for secured safe keeping (FIG. 1), and back from the safe into an extended display position for viewing, when desired. A display housing 18 is raised and lowered from the safe without having to transfer the items into a remote safe for safekeeping after and before business hours.

The security display case 10 of the present invention includes a generally rectangular shaped enclosure 12 having a defined interior that forms a lower safe portion 14, having upper and lower ends, a locking assembly 58 disposed within the safe portion proximate the upper end, and the display housing 18 having a lower lift platform 20, a top wall 19 opposite the lower lift platform 20, and a steel lid or closure member 24 mounted above the top wall 19 providing a gap therebetween.

The enclosure 12 is formed by a pair of laterally spaced sidewalls 26 and 28, upper wall 32 and lower wall 30, and front and back walls 34 and 36, the walls being generally opaque and the upper wall 32, lower wall 30, front wall 34, and back wall 36 extending between sidewall 26 and sidewall 28 wherein to define an interior for receiving the display housing 18. The upper wall 32 has a central opening 25 through which the display housing 18 extends and retracts.

As noted above, the display housing 18 is stowable within the safe portion 14 of the enclosure 12.

The display housing 18 is of such a size to essentially fill the interior of the safe portion 14 but move therewithin between a lowered or security position completely disposed within the safe portion 14 and securely sealed therewithin by the closure member 24. The top wall 19 is interconnected to the lower lift platform 20 by a pair of opposing sidewalls 22*a*, 22*c*, a front wall 22*b*, and a back wall 22*d*.

Figure 5:
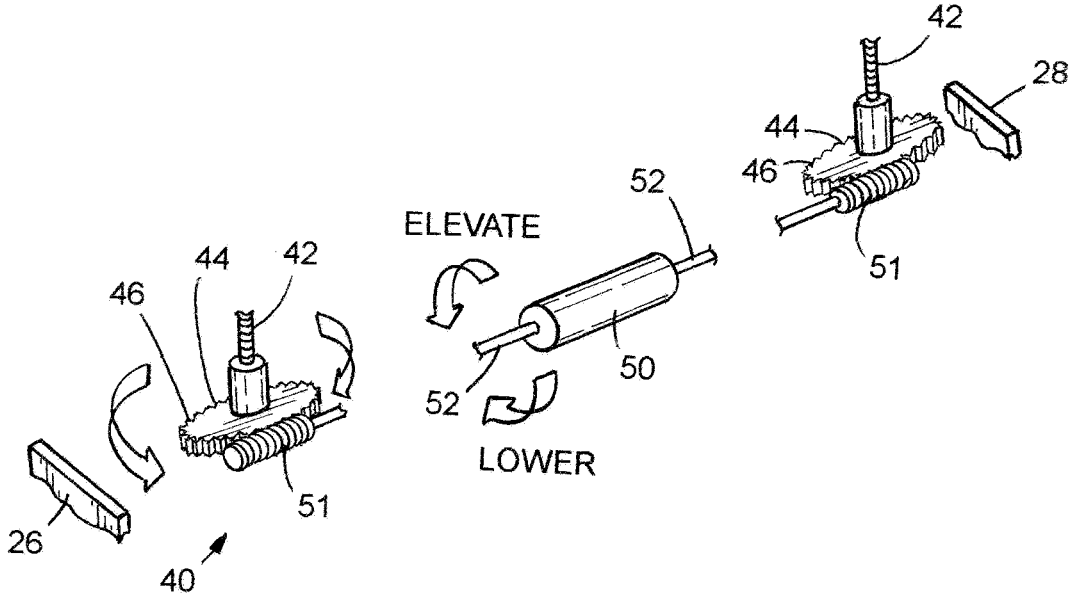
FIG. 5 is a partial exploded view, in perspective, of a lift mechanism.

As shown in FIG. 5, a lift mechanism 40 is provided for moving the lift platform 20 between the security and display positions, the lift mechanism 40 being disposed in the safe portion and drivingly connected to the lift platform 20. The lift mechanism 40 includes a pair of axially elongated, substantially parallel drive rods 42, a mounting arrangement for mounting opposite ends of the drive rods 42 to the upper and lower ends of the safe portion 14 for relative rotation thereto, a connecting arrangement for connecting the drive rods 42 to the lift platform 20, and drive means for substantially simultaneously rotating each of the drive rods 42 whereby the connecting arrangement between the rods 42 and the lift platform 20 cause the lift platform 20 to move axially relative to the drive rods 42 and to move vertically between a respective security and display position.

As shown in FIG. 5, the mounting arrangement includes a circular drive plate 44 for mounting each respective drive rod 42, each drive plate 44 being mounted for rotation on the lower wall of the safe portion 14 and providing the circumference of each respective plate 44 with gear teeth 46. The opposite ends of the drive rods 42, respectively, are journaled in the upper end of the safe portion 14 and fixedly secured to a respective drive plate 44 for rotation.

The connecting arrangement includes a pair of drive blocks 48 mounted on opposite respective sides of the lift platform 20, each drive block 48 having a threaded through bore. The drive rods 42 are axially elongated, threaded, and threadably connected to the through bore of a respective drive block 48, wherein in situ rotation of the drive rods 42 in one or the other direction causes the drive blocks 48 to move the lift platform 20 up or down depending on the sense of the rotation.

The drive means comprises a first drive motor 50 drivingly connected to each of the drive rods 42, the first drive motor 50 being disposed in the safe portion 14 below the display housing 18 and includes a pair of drive shafts 52, the drive shafts 52 being drivingly connected to a respective drive rod 42. In a preferred embodiment, each drive shaft 52 terminates in a gear member 51 that is drivingly connected to the gear teeth 46 provided on the circumference of a respective drive plate 44. Energization of the first drive motor 50 causes the drive shafts 52 thereof to substantially simultaneously rotate the gear members 51 and transmit rotational torque to rotate both of the drive plates 44 and associated drive rods 42. Rotations of the drive rods 42 causes the lift platform 20 to raise or lower, depending on the sense of rotation of the drive rods 42.

Figure 8:
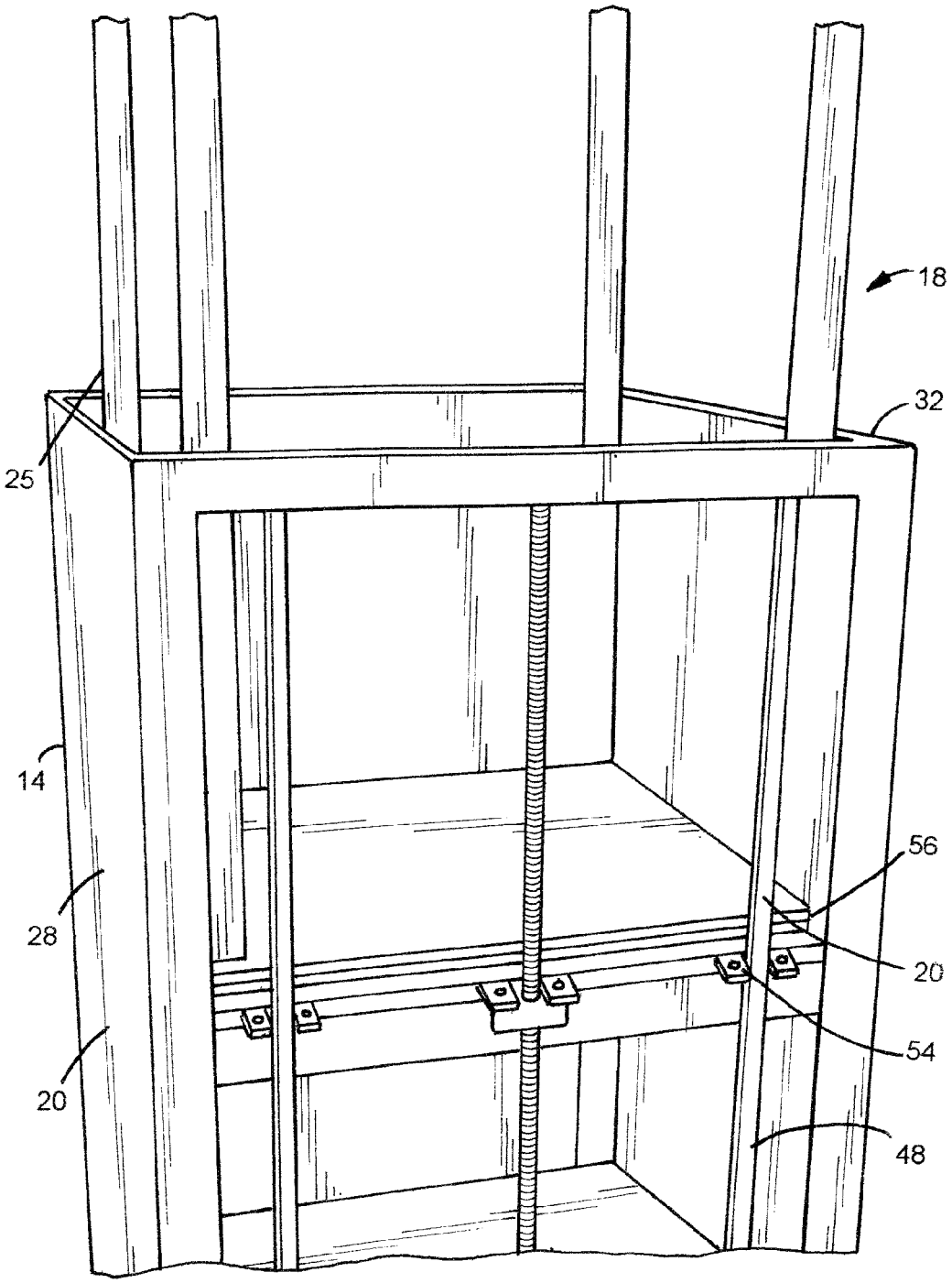
FIG. 8 is a perspective view, with components eliminated showing the display assembly partially raised.

Additionally, and as shown in FIG. 8, the security display case 10 further comprises an arrangement for stabilizing the lift platform 20 for horizontal movement relative to the enclosure 12 during movement of the of the lift platform 20 between the lower security and raised display positions. According to a preferred arrangement, there is provided a first and second pair of guide members 54 with associated guide rods 56, the respective pairs of guide members 54 being mounted on one and the other drive block 48 with each guide member 54 receiving a respective guide rod 56, the guide rods 56 extending between the upper and lower ends of the safe portion 14 and constraining the lift platform 20 to remain oriented horizontally when moving between the security and display positions.

As noted above, the display case 10 includes a locking assembly 58 for locking the display housing 18 to the enclosure 12 when the display housing 18 is in the security position.

In a preferred embodiment, the locking assembly 58 is mounted within the safe portion 14 of the enclosure 12, proximate the upper wall 32. As shown, a pair of locking assemblies 58, 58' is used wherein each locking assembly 58, 58' is mounted opposite one another within the safe portion 14 of the enclosure 12. Each locking assembly 58, 58' has a plurality of discs 64, the plurality of discs 64 being adapted to rotate about a vertical axis between an unlocked and locked position, thereby extending and retracting into and out of an unlocked and locked position.

Turning to FIGS. 3, 4, 6A, 6B, 7A, and 7B, the preferred embodiment of each locking assembly 58, 58' further includes a rod 66, each disc 64 being rotatably connected to the rod 66 and adapted to be rotatably extended and retracted. When in the extended position, each disc 64 rotates to position itself within the gap provided between the top wall 19 of the display housing 18 and the above mounted closure member 24, thereby locking the display housing 18 within the enclosure 12.

Each locking assembly 58, 58' further includes a locking member 60 mounted within the enclosure 12 and a lever 62 pivotally attached to the locking member 60, the lever 62 being connected to the rod 66 by a hinge 61. Each locking assembly 58, 58' further includes at least one second drive motor 68, and a pair of trip switches, an unlock trip switch 70*a* and a lock trip switch 70*b*, disposed on the locking member 60.

The second drive motor 68 is in operable driving relation to the lever 62 and in electrical communication relation to the trip switches 70*a*, 7*b*. Energization of the second drive motor 68 operates to pivot the lever 62 about the locking member 60 such that the rod 66 extends or retracts based on the operation of the second drive motor 68.

As each disc 64 is pivotally fixed to the enclosure 12 at an enclosure pivot 67 and pivotally fixed to the rod 66 at a rod pivot 65, the extension and retraction of the rod 66 causes each disc 64 to rotate outwardly and inwardly, respectively. It is to be understood that the configuration of the lever 62, rod 66, and each disc 64 may be modified such that each disc 64 rotates in opposite directions based on the movement of the lever 62 and rod 66.

A control system controls each locking assembly 58, 58' and lift mechanism 40. The control system includes an actuator switch 72, the first and second drive motors 50 and 68, the trip switches 70*a*, 70*b*, and the limit switches 74, 76.

The actuator switch 72 is externally operated by a key and is initially in a "neutral position," but selectively positionable to either an "up" or a "down" position to energize the second drive motor 68 when the actuator switch 72 is positioned to the "up" position and the first drive motor 50 when the actuator switch 72 is positioned to the "down" position.

The lower and upper limit switches 74, 76 are engaged by movement of the display housing 18. Engagement of either the lower or upper limit switch 74, 76 by the lift platform 20 will cause the first drive motor 50 to de-energize and position the display housing 18 in one and the other security and display positions. Similarly, the lock and unlock trip switches 70*a*, 70*b* are engaged by movement of the lever 62. Engagement of either the lock or unlock trip switches 70*a*, 70*b* by the lever 62 will cause the second drive motor 68 to de-energize and position each disc 64 in one and the other lock and unlock positions.

Preferably, the unlock trip switch 70*b* is in electrical communication with the first drive motor 50 such that when the unlock trip switch 70*b* is engaged by the lever 62, and each disc 64 in the unlocked position, the second drive motor 68 is de-energized and the first drive motor 50 is energized, thereby lifting the display housing 18. Similarly, it is preferred that the lower limit switch 74 is also in electrical communication with the second drive motor 68 such that when the lower limit switch 74 is engaged by the display housing 18, the first drive motor 50 is de-energized and the second drive motor 68 is energized, thereby rotating each disc 64 and locking the display housing 18 within the enclosure 12. Configuring the trip switches 70*a*, 70*b* and limit switches 74, 76 as noted above, ensures that the motors 50, 68 do not burn out from operating past the threshold and, additionally, that the motors 50, 68 do not operate simultaneously. Doing so would cause the lift mechanism 40 and each locking assembly 58, 58' to operate at the same time while the display housing 18 is not in an appropriate position.

Assume the display housing 18 is initially in the security position and locked in the safe portion 14 by each disc 64. Movement of the actuator switch 72 to the "up" position will energize the second drive motor 68 whereby the second drive motor 68 will cause each disc 64 to retract from their position within the gap between the top wall 19 of the display housing 18 and the closure member 24, thus disengaging the display housing 18. Once each disc 64 is fully retracted via the rod pivot 65 and the enclosure pivot 67, the lever 62 engages the unlock trip switch 70*b* and the second drive motor 68 is de-energized and the first drive motor 50 is energized. The first drive motor 50 will effect movement of the display housing 18 upward and away from the lower limit switch 74. Ultimately, the lift platform 20 will engage the upper limit switch 76 whereupon a signal will be sent to de-energize the first drive motor 50 and position the display housing 18.

The above process is reversed when the user wishes to place the display housing 18 in locked relation within the safe portion 14. The actuator switch 72 is turned to "down"

position whereupon electrical signals are sent to first drive motor 50. The display housing 14 is lowered into the enclosure 16 and, upon the display housing 18 engaging the lower limit switch 74, the first drive motor 50 is de-energized and the second drive motor 68 is energized. Upon the second drive motor 68 being energized, the lever 62 pivots in order to retract the rod 66 and rotate each disc 64 into locking engagement within the gap between the top wall 19 of the display housing 18 and the closure member 24. Once each disc 64 is fully rotated outwardly via the rod pivot 65 and the enclosure pivot 67, the lever 62 engages the lock trip switch 70*a*, and the second drive motor 68 is de-energized.

Alternatively, the first and second drive motors 50, 68 may be separately activated by associated actuator switches wherein the unlock trip switch 70*b* does not energize the first drive motor 50 and the lower limit switch 74 does not energize the second drive motor 68. Instead, the first drive motor 50 and the second drive motor 68 each have a separate associated actuator switch to operate the lift mechanism 40 and each locking assembly 58, 58' individually.

In the preferred embodiment, the display case 10 is either fixedly mounted to the floor or freestanding and able to be moved.

The display case 10 may be mounted to the floor via a plurality of bolts or the like extending through the lower wall 30 and the floor. Alternatively, the display case 10 may be mounted to the floor via a plurality of L-shaped brackets or the like bolted to the side walls 26, 28, front wall 34, back wall 36, or combination thereof wherein the plurality of brackets is similarly bolted to the floor and the display case 10 is secured thereto.

While the display case 10 may be abutted against a wall, when the display case 10 is spaced away from a wall, thus allowing a person to walk around and view the entirety of the display case 10, it is preferred that each wall of the display housing 18 is at least partially transparent.

Figure 9:
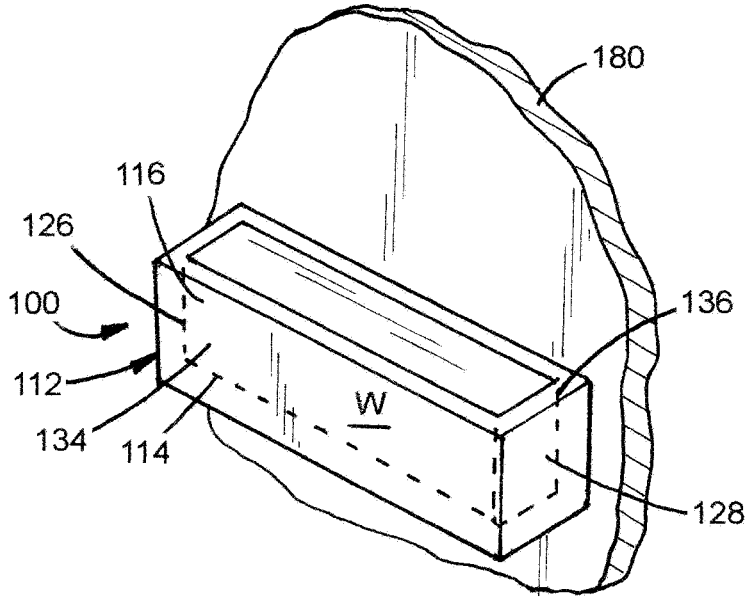
FIG. 9 is a partial perspective view of an alternate embodiment of a display case according to this invention.
Figure 6A:
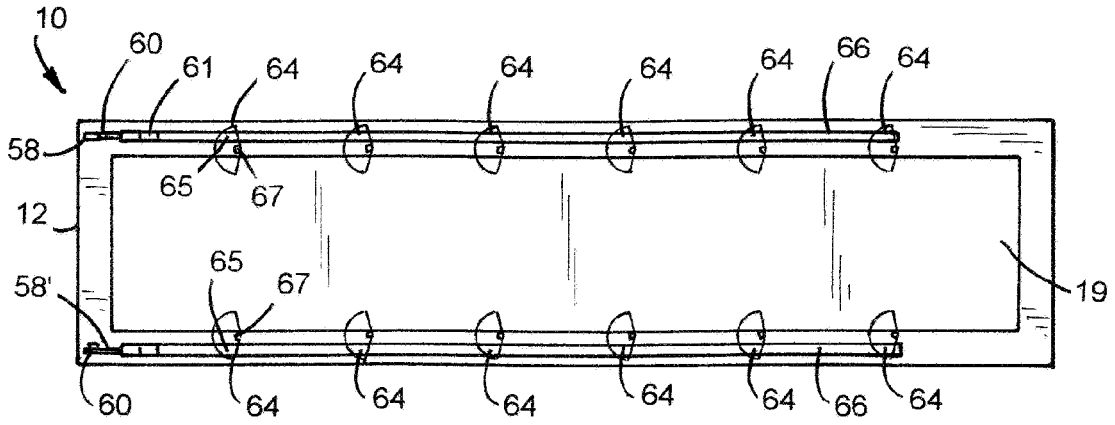
FIG. 6A is a top view of the display case without the closure member showing a plurality of discs in the extended position and the display housing locked in the safe portion.
Figure 6B:
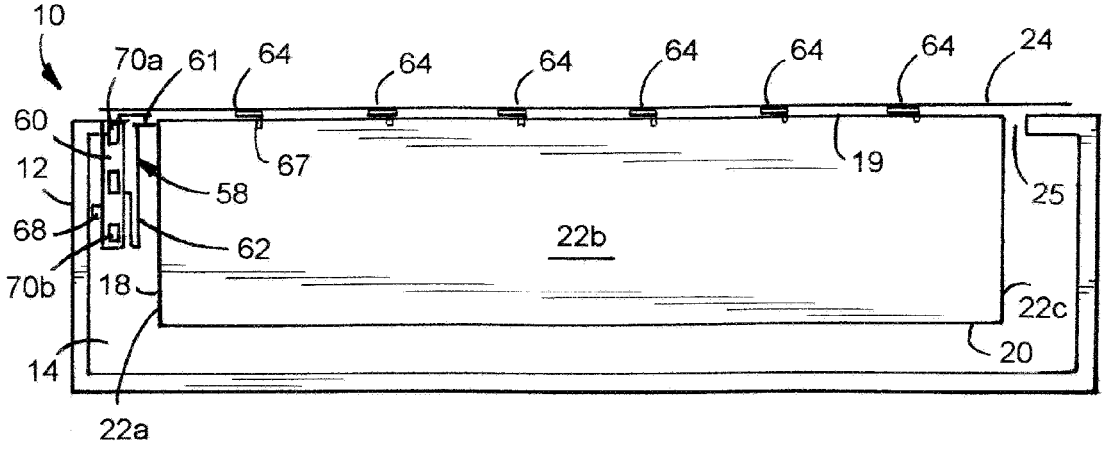
FIG. 6B is a partial cross-sectional front view showing the plurality of discs in the extended position within a gap provided between the top wall of the display housing and the closure member.
Figure 7A:
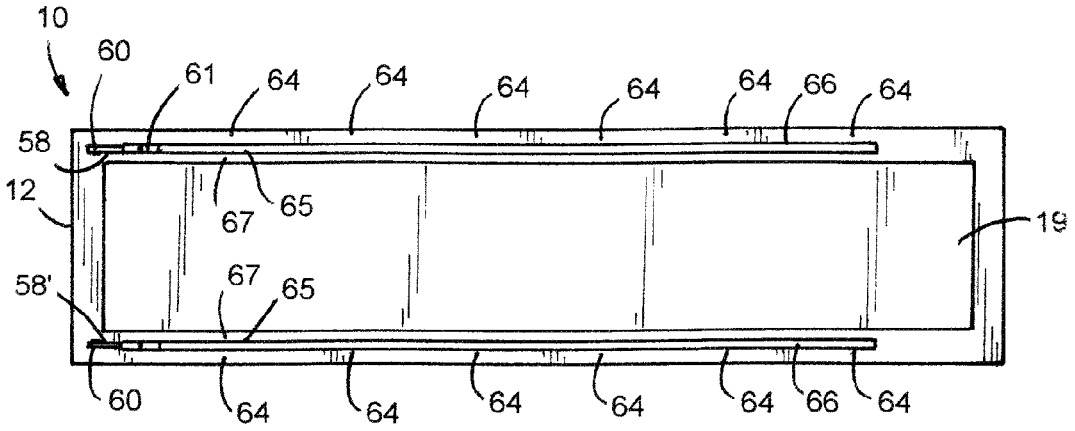
FIG. 7A is a top view of the display case without the closure member showing the plurality of discs in the retracted position and the display housing unlocked in the safe portion.
Figure 7B:
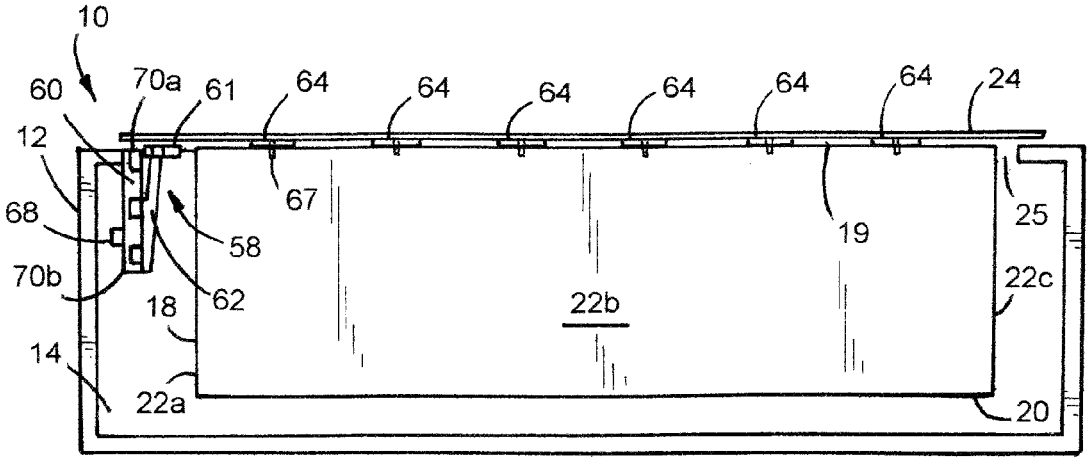
FIG. 7B is a partial cross-sectional front view showing the plurality of discs in the retracted position.

Further, referring to FIG. 9, a perspective view of an alternate embodiment of a display case according to this invention is denoted at 100, the display case 100 being wall mounted and above the floor of a room.

According to this aspect of the present invention, the security display case 100 comprises elements that are substantially the same in structure and function as described with respect to the display case 10 hereinbove. In general, the display case 100 comprises an enclosure 112 formed by a pair of sidewalls 126 and 128, a front wall 134, a back wall 136, the walls cooperating, at least in part, to form a safe portion 114 and a display housing 116, the front wall 134 of the display housing 116 is at least partially transparent to provide a viewing window W. The lift arrangement for moving the display housing 116 from the safe portion 114 into display and the locking assembly retain the same structure as applied in the above embodiment.

According to this embodiment, the back wall 136 is adapted to mount the enclosure 112 in a room wall 180 in vertically spaced relation to the floor of the room.

It should be noted that in either embodiment, the safe portion is preferably formed of steel or other hardened metal which, for decorative purposes, may be provided with a cladding such as wood or the like which is fastened thereto with any suitable means.

Similarly, the base or bottom wall of the display housing is secured to the lift platform with suitable fasteners such as screws, bolts or the like. Also, regardless of which locking assembly is deployed, it is secured within the enclosure with suitable fasteners.

Having thus described the invention, what is claimed is:

1. A security display case comprising:

(a) an enclosure, the enclosure comprising a pair of laterally spaced sidewalls, an upper wall, a lower wall, a front wall, and a back wall, the walls being generally opaque, the upper wall, lower wall, front wall, and back wall extending between the pair of sidewalls to define an interior, the interior defining a lower safe portion and having a central opening formed in the upper wall permitting access to the interior;

(b) a display housing, the display housing moveable into and out of the safe portion of the enclosure, the display housing having a pair of laterally spaced sidewalls, a top wall, a lower lift platform, a front wall, and a back wall, the top wall, lift platform, front wall, and back wall extending between the pair of sidewalls to define an interior, at least one of the walls at least partially transparent, and a closure member mounted distally above the top wall providing a gap therebetween;

(c) a lift mechanism, the lift mechanism being disposed in the safe portion and drivingly connected to the lift platform, the lift mechanism comprising a pair of axially elongated drive rods, amounting arrangement for mounting opposite ends of the drive rods to the lower and upper walls of the enclosure, a connecting arrangement for connecting the drive rods to the lift platform, drive means for substantially simultaneously rotating each of the drive rods whereby the connecting arrangement causes the lift platform to move axially relative to the drive rods and to move vertically between a security and a display position, and a first drive motor, the first drive motor controlling the drive means;

(d) a locking assembly, the locking mechanism being mounted within the enclosure, the locking assembly comprising at least one disc and a second drive motor, the at least one disc adapted to rotatably extend into and retract out of the gap provided between the top wall and the closure member of the display housing, the second drive motor rotating the at least one disc, wherein the locking assembly further comprises: a locking member mounted within the enclosure proximate the central opening, a lever pivotally mounted to the locking member, a hinge secured to an end of the lever, a rod coupled to the lever via the hinge, the at least one disc being rotatably connected to the rod and the enclosure wherein the at least one disc is adapted to rotatably extend into and retract out of the gap provided between the top wall and the closure member of the display housing as the lever pivots about the locking member and the rod retracts and extends, respectively; and (e) a control system, the control system in communication with the first drive motor and the second drive motor.

2. The security display case of claim 1 wherein the mounting arrangement comprises: a drive plate for mounting each respective drive rod thereto, each drive plate being mounted for rotation on the lower wall of the enclosure, a plurality of gear teeth disposed on the circumference of each drive plate, the opposite ends of the drive rods being journaled in the upper wall of the enclosure.

3. The security display case of claim 1 wherein the connecting arrangement comprises: a pair of drive blocks mounted on opposite respective sides of the lift platform, each drive block having a bore throughbore, the drive rods being threadably connected to the throughbore of a respective drive block.

4. The security display case of claim 3 wherein the connecting arrangement further comprises: means for stabilizing the lift platform for parallel movement, the means for stabilizing comprises a first and a second pair of guide members with associated guide rods extending between the upper and lower walls of the enclosure, the guide members constraining the lift platform to remain oriented horizontally.

5. The security display case of claim 3 wherein the drive means comprises: a pair of drive shafts connected to opposing ends of the first drive motor, each drive shaft being drivingly connected to a respective drive rod, each drive shaft terminates at a gear member being drivingly connected to the gear teeth on the respective drive plate, the first drive motor causing the drive shafts to substantially simultaneously rotate the gear members and transmit rotational torque to rotate the drive plates and associated drive rods.

6. The security display case of claim 1 further comprising a plurality of discs rotatably connected to the rod of the locking assembly.

7. The security display case of claim 1 further comprising a pair of locking assemblies mounted opposite each other within the enclosure proximate the central opening.

8. The security display case of claim 1 wherein the control system comprises: a lower limit switch disposed proximate the lower wall of the enclosure, an upper limit switch disposed proximate the upper wall of the enclosure, the lower limit switch and the upper limit switch being in communication with the first drive motor in order to de-energize the first drive motor when engaged, an unlock trip switch disposed proximate the locking assembly, and a lock switch disposed proximate the locking assembly, the lock trip switch and the unlock trip switch being in communication with the second drive motor in order to de-energize the second drive motor when engaged, and an actuator switch having an up and a down position, the actuator switch being in communication with the first drive motor and second drive motor in order to energize the first drive motor when in the up position and the second drive motor when in the down position.

9. The security display case of claim 8 wherein the lower limit switch is in communication with the second drive motor to energize the second drive motor when engaged and the unlock trip switch is in communication with the first drive motor to energize the first drive motor when engaged.

10. The security display case of claim 8 wherein the actuator switch is a key actuated switch accessible from outside of the enclosure.

* * * * *